US007176775B2

(12) United States Patent
Ohta

(10) Patent No.: US 7,176,775 B2
(45) Date of Patent: Feb. 13, 2007

(54) TRANSFORMER AND DISCHARGE LAMP LIGHTING DEVICE

(75) Inventor: Shinji Ohta, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/399,755

(22) Filed: Apr. 7, 2006

(65) Prior Publication Data

US 2006/0227482 A1 Oct. 12, 2006

(30) Foreign Application Priority Data

Apr. 7, 2005 (JP) ..... 2005-110716

(51) Int. Cl.
*H01F 5/00* (2006.01)

(52) U.S. Cl. ..... 336/200

(58) Field of Classification Search ..... 336/65, 336/83, 200, 220–222, 232; 315/254, 276
See application file for complete search history.

(56) References Cited

U.S. PATENT DOCUMENTS 4,409,523 A * 10/1983 Yasumura ..... 315/371
5,335,163 A * 8/1994 Seiersen ..... 363/126
6,980,077 B1 * 12/2005 Chandrasekaran et al. .. 336/212
2004/0108929 A1 * 6/2004 Ichikawa et al. ..... 336/83
2006/0038650 A1 * 2/2006 Mehrotra et al. ..... 336/83

FOREIGN PATENT DOCUMENTS

JP 2001-155933 6/2001

* cited by examiner

*Primary Examiner*—Tuyen T Nguyen
(74) *Attorney, Agent, or Firm*—Fish & Richardson P.C.

(57) ABSTRACT

A transformer and discharge lamp lighting device are disclosed. The transformer includes a closed-magnetic circuit type of core having a gap, a primary winding 7*p*, a secondary winding 7*s* and a detecting terminal located on the secondary winding 7*s* or an additional detecting winding separate from the main winding. The primary winding 7*p* and secondary winding 7*s* are wound around a portion apart from a gap 14 of a common core column 13 serving as a center axis. The primary winding 7*p* is formed of a sheet- or film-like conductor, and the winding portion of the primary winding 7*p* is arranged so as to include the winding portion of the secondary winding 7*s* in the direction along the center axis of the core column 13.

5 Claims, 7 Drawing Sheets

TRANSFORMER AND DISCHARGE LAMP LIGHTING DEVICE

TECHNICAL FIELD

This disclosure relates to a transformer and discharge lamp lighting device. The disclosure also relates to technology for improving the detecting accuracy based on a detecting terminal attached to a secondary winding of a transformer or an additional detecting winding separate from a main winding in the transformer for realizing a high frequency and downsizing, and a discharge lamp lighting device using the transformer.

BACKGROUND

A transformer or coil with a low voltage and large current may be realized by using a metallic plate winding to reduce the number of manufacturing steps and to prevent bulkiness of the windings. (See, e.g., Japanese patent document JP-A-2001-155933.)

One application relates to a discharge lamp lighting circuit, such as a metal halide lamp, used in an illumination light source for a vehicle such as a motor car. DC-AC conversion may be obtained using a transformer for power transmission to the discharge lamp. The transformer is provided with a detecting terminal attached to a secondary winding or detecting winding in order to detect the voltage applied to the discharge lamp.

The voltage detected using the detecting terminal or detecting winding is used for power control of the discharge lamp or for detection of an abnormal state of the discharge lamp.

If the magnetic coupling within the transformer is not uniform in a lighting circuit for high-frequency lighting a discharge lamp in which the transformer is compact, it is difficult to detect the voltage accurately. This is attributed to the fact that the relationship between the turn ratio and voltage significantly deviates from linear as a result of the loose/dense state in the coupling within the transformer. Therefore, a correction circuit is required. This, however, may result in complicated circuit construction, upsizing and increased cost. For example, where the discharge lamp is employed as the illumination source for a motor car, the lighting circuit must be arranged within a limited space (e.g., where a lighting circuit unit is accommodated within a lamp).

One problem addressed by this disclosure is how to assure the accuracy of voltage detection in a transformer suitable for downsizing and high frequency, as well as a reduction in the number of components and cost.

SUMMARY

This disclosure provides a transformer that includes a closed-magnetic circuit type of core having a gap, a main winding composed of a primary winding and a secondary winding, and a detecting terminal located on the secondary winding or an additional detecting winding separate from the main winding. The disclosure also provides a discharge lamp lighting device using the transformer, wherein the primary winding and secondary winding are wound around a portion apart from the gap of a column of the common core serving that serves as a center axis. The primary winding is formed of a sheet- or film-like conductor. The winding portion of the primary winding is arranged with a length sufficient to include the winding portion of the secondary winding in the direction along the center axis of the core column.

Therefore, in accordance with this invention, it is possible to prevent unevenness in the distribution of magnetic coupling between the primary winding formed of the sheet- or film-like conductor and the secondary winding. That can permit accurate voltage detection. The primary winding and secondary winding can be wound around a portion apart from the gap of the common core column of the common core serving as a center axis, thereby preventing attenuation of the detecting accuracy as a result of the leakage magnetic flux in the gap.

One or more of the following advantages may be present in some implementations. The invention can result in downsizing or high frequency, and can assure voltage detecting accuracy. For example, in an application of this invention to a discharge lamp lighting device in a high frequency driving system using the transformer, the voltage applied to the discharge lamp can be detected accurately.

In a construction that includes an additional detecting winding separate from the main winding, the detecting winding can be formed of a sheet- or film-like conductor. The winding portion of the detecting winding can be provided with a length sufficient to include the winding portion of the secondary winding in the direction along the center axis of the core column. This can help improve the accuracy of voltage detection.

A pair of terminals attached to the primary winding or the detecting winding can be located at diagonal positions on the opposite sides with respect to the winding direction of the primary winding or the detecting winding. In this configuration, a primary current can be passed uniformly through the sheet- or film-like conductor, thereby preventing possible unevenness of the magnetic coupling between the primary winding and the secondary winding. Other features and advantages may be apparent from the following detailed description, the accompanying drawings, and the claims.

DETAILED DESCRIPTION

Figure 1:
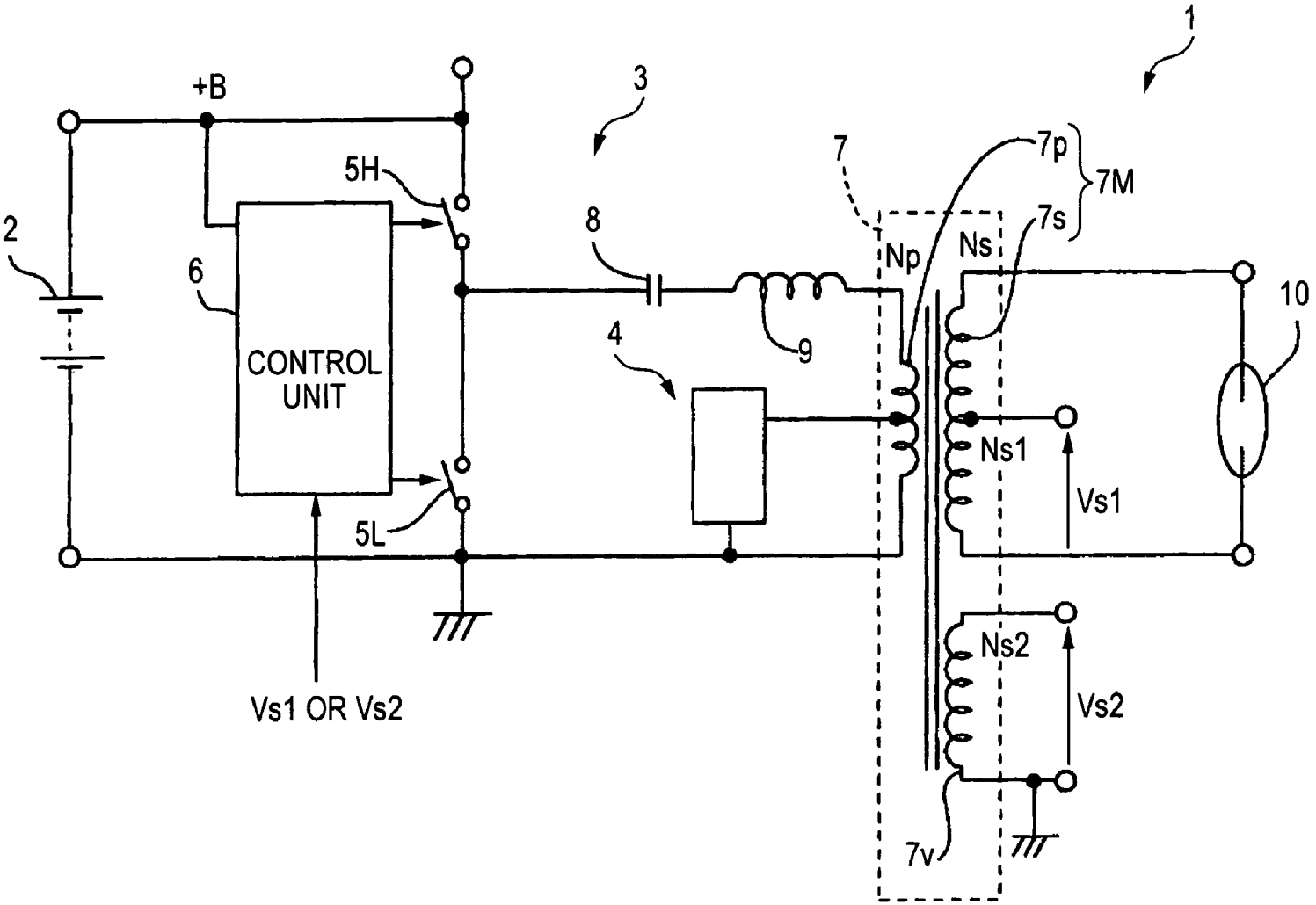
FIG. 1 is a view showing an example of a circuit construction of a discharge lamp lighting device according to this invention.

FIG. 1 shows an example of a basic construction of a discharge lamp lighting device according to this invention.

The discharge lamp lighting device 1 includes a DC-AC conversion circuit 3 supplied with power from a DC power source 2, and a starting circuit 4.

The DC-AC conversion circuit 3 receives a DC input voltage (+B in FIG. 1) from the DC power source 2 to provide DC-AC conversion and voltage boosting. The illustrated DC-AC conversion circuit 3 includes two switching elements 5H, 5L and a control unit 6 for making driving control therefor. Specifically, one end of the switching element 5H at the higher stage is connected to a power source terminal, whereas the other end is connected to ground through the switching element 5L at the lower stage. The switching elements 5H and 5L are alternately turned on/off by the control unit 6. For simplicity of illustration, the elements 5H, 5L are illustrated by a switch symbol, but may be, for example, a semiconductor switching element such as a field effect transistor (FET) or bipolar transistor.

The DC-AC conversion circuit 3 has a series resonance circuit including an inductance element or a transformer and a capacitor.

In this embodiment, the DC-AC conversion circuit 3 has a transformer 7 for power transmission, and on the primary side thereof, has a circuit construction that uses a resonance phenomenon between a resonance capacitor 8 and an inductor or an inductance component. In particular, the circuit construction can be proposed in the following three formats.

(I) Format using the resonance between the resonance capacitor 8 and an inductance element.

(II) Format using the resonance between the resonance capacitor 8 and a leakage inductance of the transformer 7.

(III) Format using the resonance between the resonance between the resonance capacitor 8, and the inductance element and leakage inductance of the transformer 7.

According to the first format (I), the following circuit configuration can be adopted. An inductance element 9 such as a resonance coil is added. Its one end is connected to the resonance capacitor 8. The resonance capacitor 8 is connected to a connecting point between the switching elements 5H and 5L. The other end of the inductance element 9 is connected to the primary winding 7*p* of the transformer 7.

According to the second format (II), the addition of the inductance element, such as the resonance coil, is not required because the inductance component of the transformer 7 is employed. The circuit configuration is as follows. One end of the resonance capacitor 8 is connected to the connecting point of the switching elements 5H and 5L, whereas the other end of the capacitor 8 is connected to the primary winding 7*p* of the transformer 7.

In the third format (III), the series composite reactance of the inductance 9 and the leakage inductance can be used.

In all the foregoing formats, by using the series resonance between the resonance capacitor 8 and the inductive element (inductance component or inductance element), the driving frequency of the switching elements 5H, 5L is set at a value not lower than the series resonance frequency and the switching elements are alternately turned on/off. In this way, a discharge lamp 10 (e.g., metal halide lamp for a vehicle) connected to a secondary winding 7*s* of the transformer 7 can be lit in a sinusoidal manner. During driving control of each switching element by the control unit 6, the switching elements should be oppositely driven so that the switching elements are not both placed in their ON state (by the control of "on-duty"). Assuming, for example, that the resonance frequency before lighting is f1, the resonance frequency in the lighting state is f2, the electrostatic capacitance of the resonance capacitor 8 is Cr, the inductance of the inductance element 9 is Lr, and the primary side inductance of the transformer 7 is Lp1, then, in the third format (III), before the discharge lamp is lit, the series resonance frequency $f1=1/(2\cdot\pi\cdot\sqrt{(Cr\cdot(Lr+Lp1))})$. For example, if the driving frequency is lower than f1, the loss of the switching elements is large which reduces the efficiency. Therefore, the switching operation is carried out at a frequency range higher than f1. After the discharge lamp has been lit, $f2\cong 1/2\cdot\pi\cdot\sqrt{(Cr\cdot Lr)}$ ($f1<f2$). The switching operation is carried out in a frequency range higher than f2.

The starting circuit 4 supplies a start signal to the discharge lamp 10. For example, on the basis of the voltage caused by an auxiliary winding added to a voltage generating section (not shown) or the transformer 7, the signal generated in the primary winding 7*p* of the transformer 7 is boosted by the transformer 7 and applied to the discharge lamp 10 (i.e., the start signal superposed on the AC-converted output is supplied to the discharge lamp 10).

The transformer 7 has a main winding 7M composed of the primary winding 7*p* and the secondary winding 7*s*. The transformer 7 provides power transmission to the discharge lamp 10 connected to the secondary winding 7*s*. The voltage applied to the discharge lamp 10 is detected in the following two formats (designated (A) and (B)). For convenience of explanation, both formats are illustrated, but only one need be adopted in a particular implementation.

(A) obtaining the detected voltage from a detecting terminal located on the way of the secondary winding (B) Using an additional detecting winding separate from the main winding In the first format (A), on the way of the secondary winding 7*s* of the transformer 7, the detecting terminal detects the voltage. For example, with the number of turns and voltages set as shown in the drawing, the relationship Ns/Np=Vs/Vp is applicable. Thus, from Ns1/Ns=Vs1/Vs, the relationship Vs1=Vs×(Ns1/Ns) is obtained.

The various values in the foregoing equations are defined as follows.

Np=the number of turns of the primary winding 7*p* of the transformer 7.

Ns=the number of turns of the secondary winding 7*s* of the transformer 7.

Ns1=the number of turns to the detecting terminal on the way of the secondary winding 7*s*.

Vp=a primary voltage.

Vs=a secondary voltage.

Vs1=a detected voltage from the detecting terminal.

In the second format (B), a detecting winding 7*v* is added on the secondary side of the transformer 7 to detect the voltage. For example, with the number of turns and voltages set as shown in the drawing, the relationship Ns/Np=Vs/Vp applies. Thus, from Ns2/Ns=Vs2/Vs, the relationship Vs2=Vs×(Ns2/Ns) is obtained.

The values Ns2 and Vs2 are defined as follows.

Ns2=the number of turns of the detecting winding 7*v*.

Vs2=the detected voltage obtained from the detecting winding 7*v*.

In both formats (A) and (B), assuming that the transformer 7 has an ideal transforming characteristic, the voltage proportional to the turn ratio to the secondary winding (Ns1/Ns, Ns2/Ns) is detected, thereby providing a linear characteristic.

However, in actual implementations in which the transformer uses round windings, the linear characteristic cannot readily be obtained.

Figure 2:
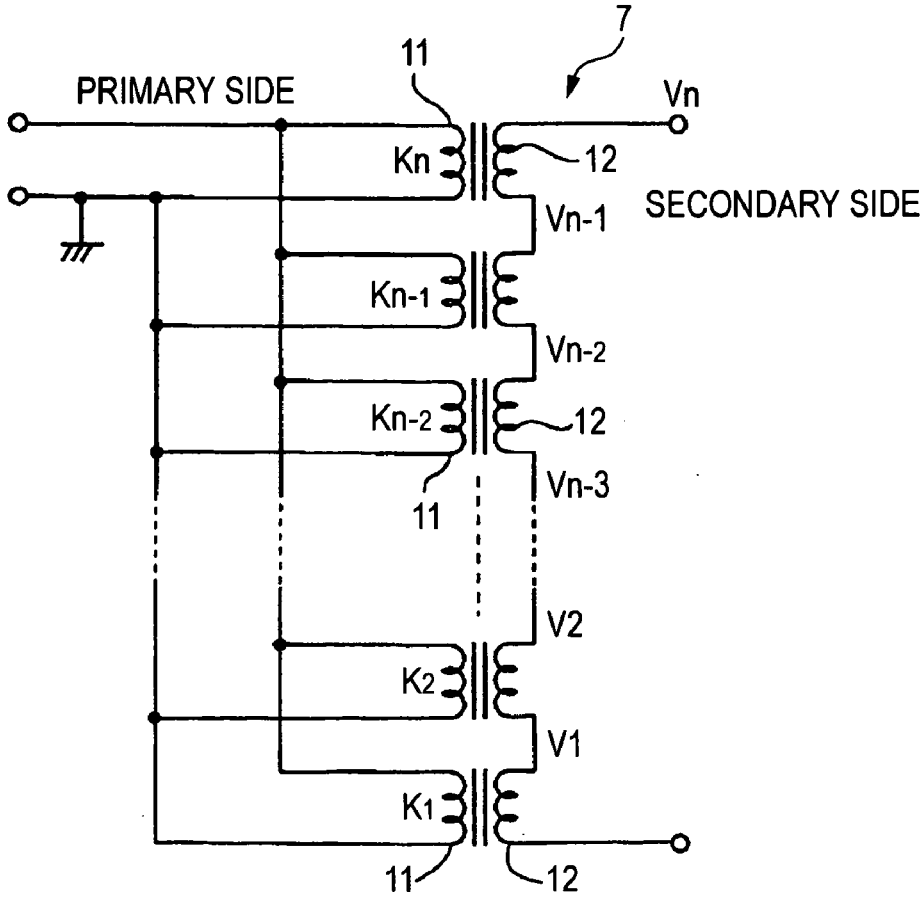
FIG. 2 is an equivalent circuit diagram of a transformer.
Figure 3:
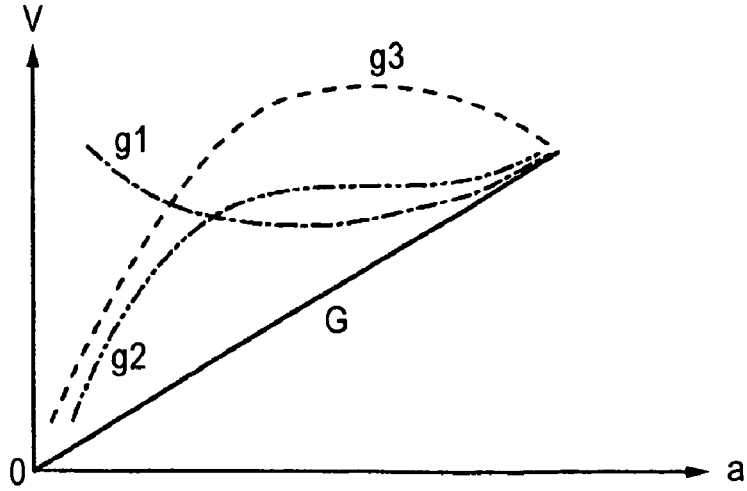
FIG. 3 is a graph for explaining the relationship between the ratio of the number of turns and a detected voltage.

FIGS. 2 and 3 are views for explaining the reason therefor.

FIG. 2 is an equivalent circuit diagram of the main winding 7M of the transformer 7. FIG. 3 is a graph showing a characteristic of the transformer.

First, as seen from FIG. 2, the transformer 7 can be regarded as an assembly of n-number of small transformers. In FIG. 2, the coupling coefficient of each of the small transformers is defined as Ki (i=1, 2, . . . n).

On the primary side of the transformer 7, n-number of equivalent windings 11, 11, . . . are connected in parallel. On the secondary side of the transformer 7, n-number of equivalent windings 12, 12, . . . are connected in series. (In FIG. 2, Vi (i=1, 2, . . . n) represents the potential at the connecting position of each winding 12 and the potential at the output terminal).

FIG. 3 is a graph schematically showing the relationship between the number of turns a in a horizontal axis and the detected voltage V in a vertical axis.

In an ideal transformer, the linear characteristic, indicated as a graphic line G, can be obtained. For example, in the first format (A), a detected voltage that is proportional to the turn ratio can be obtained from the detecting terminal on the way of the secondary winding. This corresponds to the case where all the coupling coefficients Ki (i=1, 2, . . . , n) of the small transformers are equal.

On the other hand, if the coupling coefficients Ki (i=1, 2, . . . , n) are not equal, the deviation from the linear characteristic becomes apparent as indicated by graphic lines g1 to g3. For example, graphic lines g1 and g2 indicate the characteristics in the case where only the value of a specific coupling coefficient (e.g., K1 or K5) is changed. Graphic line g3 indicates the characteristic in the case where the values of the coupling coefficients are different from one another by small magnitudes.

As described above, owing to the presence of the loose/dense magnetic coupling within the transformer (i.e., unevenness in the distribution of the coupling coefficient values of the small transformers), voltage detection according to the linear characteristic cannot be carried out. In other words, if the uniform coupling state within the transformer is realized, in the formats (A) and (B), accurate voltage detection can be assured regardless of the coupling within the entire transformer.

FIGS. 4 to 9 show examples of the structure of the transformer according to this invention.

Figure 4:
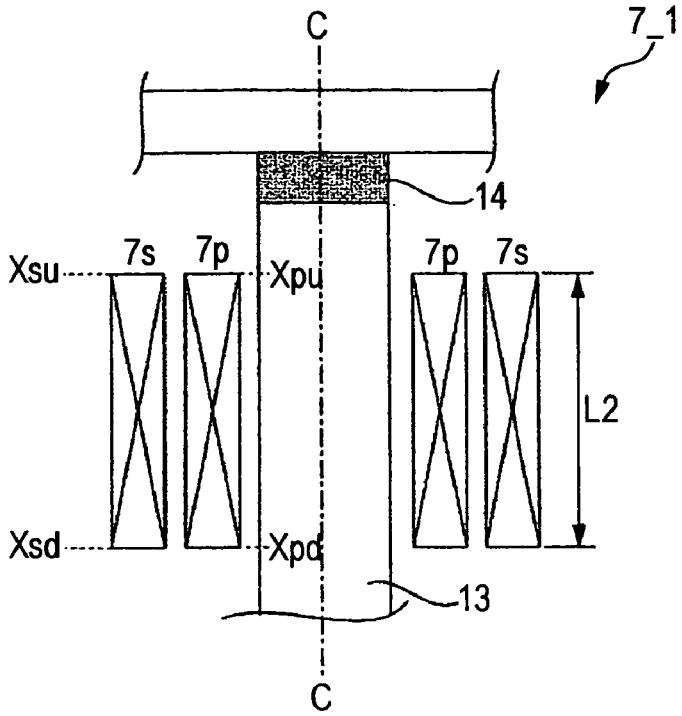
FIG. 4 is a schematic view of the main part of the basic structure of the transformer according to this invention.
Figure 4:
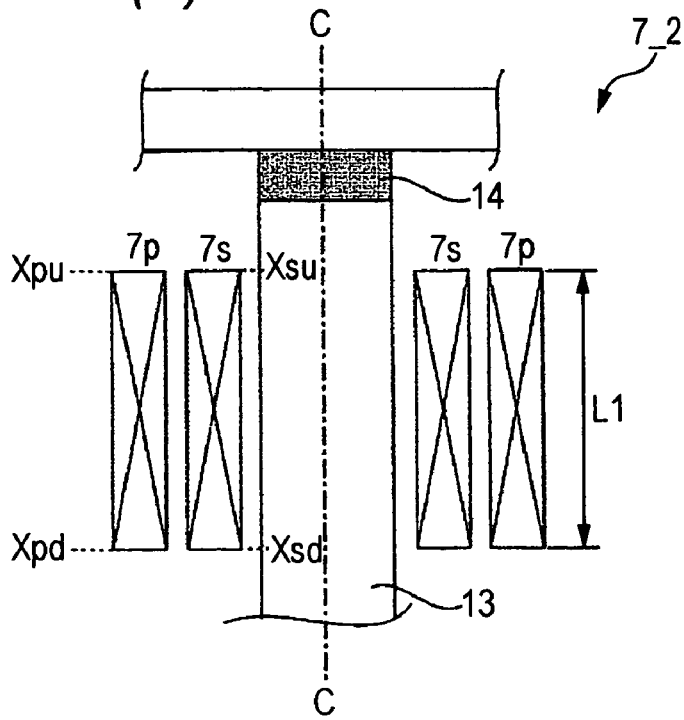

FIG. 4 is a schematic view of the main part of the basic structure of the transformer 7.

The primary winding 7*p* and secondary winding 7*s* which constitute the main winding 7M are wound around a common core column 13 as a central axis (C—C line in FIG. 4) by one or more turns on the portion apart from a gap (air gap or nom-magnetic gap) 14.

For example, in a format 7_1 shown in FIG. 4(A), the primary winding 7*p* is arranged around the core column 13 and the secondary winding 7*s* is arranged outside the primary winding 7*p*. In a format 7_2 shown in FIG. 4(B), the secondary winding 7*s* is arranged around the core column 13 and the primary winding 7*p* is arranged outside the secondary winding 7*s*.

In an application of this invention, in both the foregoing formats, the winding portion of the primary winding 7*p* is located with a length sufficient to include that of the secondary winding 7*s* in a direction along the center axis of the core column 13. Specifically, with an X-axis (the upward direction is a positive direction) set in the direction along the center axis C—C of the core column 13, assuming that the upper end position of the winding portion of the primary winding 7*p* is Xpu, the lower end position thereof is Xpd and the length of the winding portion thereof is L1 (=Xpu−Xpd). Assuming that the upper end position of the secondary winding 7*s* in the X-axis direction is Xsu, the lower end position thereof is Xsa and the length of the winding portion thereof is L2 (=Xsu−Xsd), L1≧L2, Xpu≧Xsu, and Xpd≦Xsd.

Figure 5:
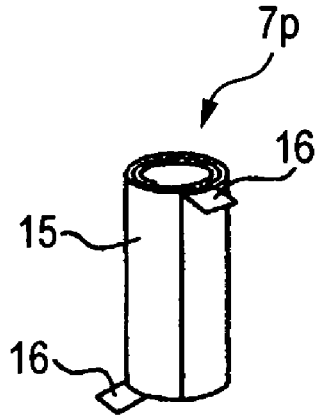
FIG. 5 is a view showing an example of the structure of the primary winding.
Figure 5:
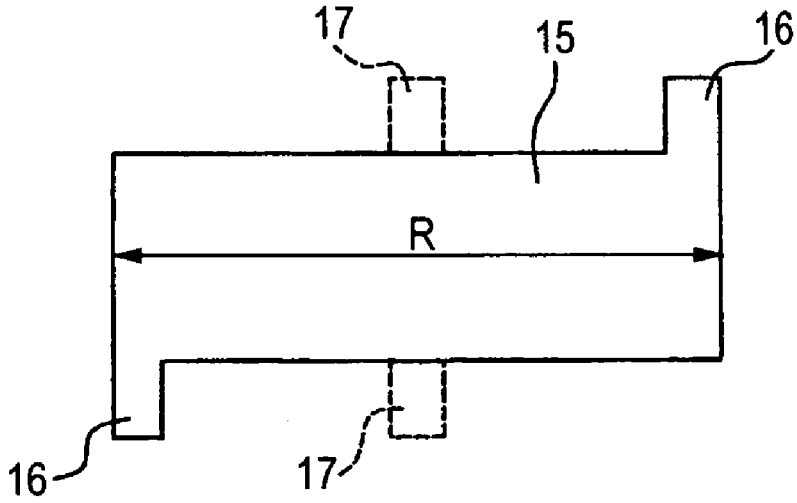

FIG. 5 shows an example of the structure of the primary winding 7*p* which is formed of a sheet- or film-like conductor.

FIG. 5(A) shows the primary winding 7*p* wound around the periphery of the core column. FIG. 5(B) is a view before winding.

The conductor portion 15 of the primary winding 7*p* is formed in a cylindrical shape by winding the thin conductor around the center axis spirally when viewed from the center axis.

The primary winding 7*p* is provided with a pair of terminals 16, 16. As seen from FIG. 5(B), these terminals 16, 16 are located at diagonal positions on the opposite sides with respect to the winding direction of the primary winding 7*p* (arrow "R" direction shown in FIG. 5(B)). Thus, a primary current flows uniformly through the conductor portion of the primary winding 7*p* so that the coupling between the primary winding and the second winding is uniform.

A connecting terminal 17 to the starting circuit 4 (indicated by broken line in FIG. 5(B)) may be formed on either long side extending in the winding direction of the primary winding 7*p*.

The medium of the primary winding 7*p* may be, e.g., a metallic sheet or flexible film-like conductor (flexible printed wiring board).

The secondary winding 7*s* may be, for example, a round wire. However, by adopting the "edgewise winding" in which a flat wire is circularly wound in a superposed manner, the transformer can be constructed with a minimum size while suppressing copper loss.

Next, an explanation is given of examples of specific constructions of the transformer. The transformer is provided with a closed magnetic circuit type of core having a gap. For example, as described below, the magnetic circuit of the transformer can use an E-type core, U-type core, etc.

Combined structure of two E-type cores

Combined structure the E-type core and an I-type core

Combined structure of two U-type cores

Combined structure of the U-type core and the I-type core

The magnetic circuit is closed to round the magnetic core and gap. An open type construction, such as only an I-type core, is excluded.

FIGS. 6 to 9 show examples of combined structures of the E-type core and the I-type core. In these combined structures, the main winding is wound around the linear portion of the core, which serves as a common axis so that the primary winding of a sheet- or film-like conductor completely is wound in a roll-shape so as to include the secondary winding in the direction of the common axis.

Figure 6:
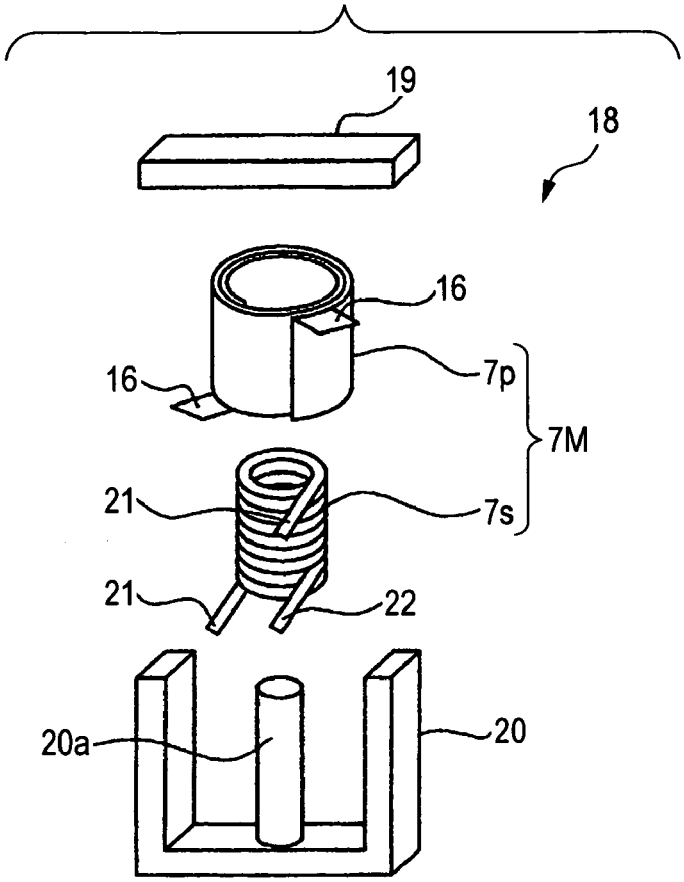
FIG. 6 is a view showing an example of the structure of the transformer together with FIG. 7, and is an exploded perspective view of the main part.
Figure 7:
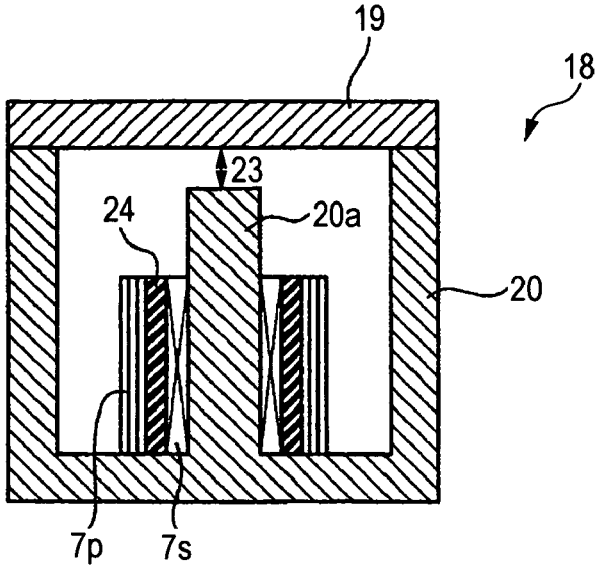
FIG. 7 is a view showing the sectional structure of the primary winding.

In the structure shown in FIGS. 6 and 7, the main winding 7M is wound around the linear portion of the core column of the E-type core.

FIG. 6 is an exploded perspective view of the main part of the transformer 18 which includes an I-type core 19, primary winding 7*p*, secondary winding 7*s* and an E-type core 20. FIG. 7 shows the sectional structure of the transformer 18.

In this structure, the secondary winding 7*s* is located around a core column 20*a* that serves as the middle leg of the E-type core 20. The secondary winding 7*s* is provided with a detecting terminal 22 located at a predetermined position (e.g., the second turn) on the way of the winding, in addition to a pair of terminals 21, 21. The detected voltage is taken from the detecting terminal 22.

On the outer periphery of the secondary winding 7*s*, the primary winding 7*p* is arranged through an insulator (FIG. 7).

As seen from FIG. 7 (in the sectional structure of the transformer 18 in a plane including the center axis of the core column 20*a*) the winding portion of the primary winding 7*p* completely includes the outside of the winding portion of the secondary winding 7*s*. Both windings are arranged to be apart from a gap 23 of the magnetic circuit (i.e., the gap formed between the end of the core column 20*a* and the I-type core 19). An insulator 24 (e.g., an insulating bobbin) is arranged between the primary winding 7*p* and the secondary winding 7*s* so that both windings are insulated electrically from each other.

Figure 8:
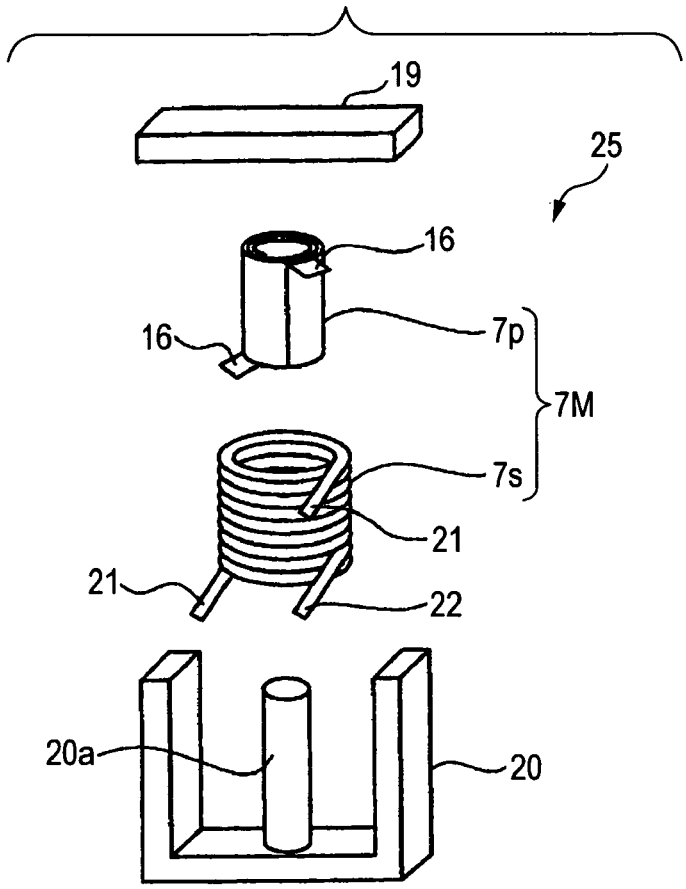
FIG. 8 is a view showing an example of the structure of the transformer together with FIG. 9, and is an exploded perspective view of the main part.
Figure 9:
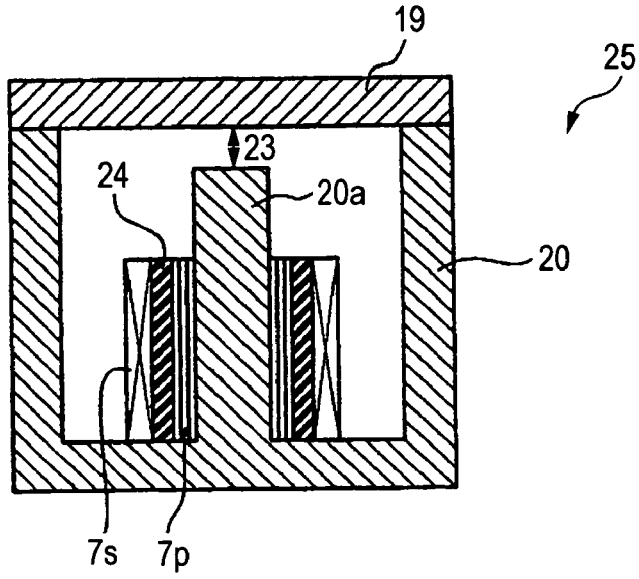
FIG. 9 is a view showing the sectional structure.

In the structure shown in FIGS. 8 and 9, the arrangement of the primary winding and secondary winding is the reverse of that in the foregoing structure.

FIG. 8 is an exploded perspective view of the main part of a transformer 25 which includes the I-type core 19, primary winding 7*p*, secondary winding 7*s* and E-type 20. FIG. 9 shows the sectional structure of the transformer 25.

In this structure, the primary winding 7*p* is located around the core column 20*a* that serves as the middle leg of the E-type core 20. The secondary winding 7*s* is arranged on the outer periphery of the primary winding 7*p* through the insulator (FIG. 9). The detected voltage is taken from the detecting terminal 22 located at a predetermined position (e.g., the second turn) on the way of the secondary winding.

As seen from FIG. 9 (in the sectional structure of the transformer 25 cut in a plane including the center axis of the core column 20*a*) the winding portion of the primary winding 7*p* completely includes the inside of the winding portion of the secondary winding 7*s*. Both windings are arranged to be apart from the gap 23 of the magnetic circuit. In this structure also, the insulator 24 is arranged between the primary winding 7*p* and the secondary winding 7*s* so that both windings are insulated electrically from each other.

In the structures shown in FIGS. 6 to 9, the primary winding 7*p* is formed of a metallic sheet, and the insulator was arranged between the primary winding 7*p* and the secondary winding 7*s*. However, in some implementations, the primary winding 7*p* may be constructed in the following formats.

- Winding a flexible material such as FPC (flexible printed wiring board) in a cylindrical shape.
- Winding a conductor-evaporated film material (e.g., PEN).
- Inserting an insulating film between layers in order to insulate these layers from one another.

All the formats are effective to prevent bulkiness of windings and can provide sufficient inter-layer insulation.

In the structures described above, the detected voltage was taken from the detecting terminal 22 of the secondary winding 7*s*. In the format in which the detecting winding 7*v* is added to detect the voltage, the detecting winding is formed of the sheet- or film-like conductor like the primary winding 7*p*. The winding portion of the detecting winding is located with a length enough to include the winding portion of the second winding 7*s* in the direction along the center axis of the core column.

Figure 10:
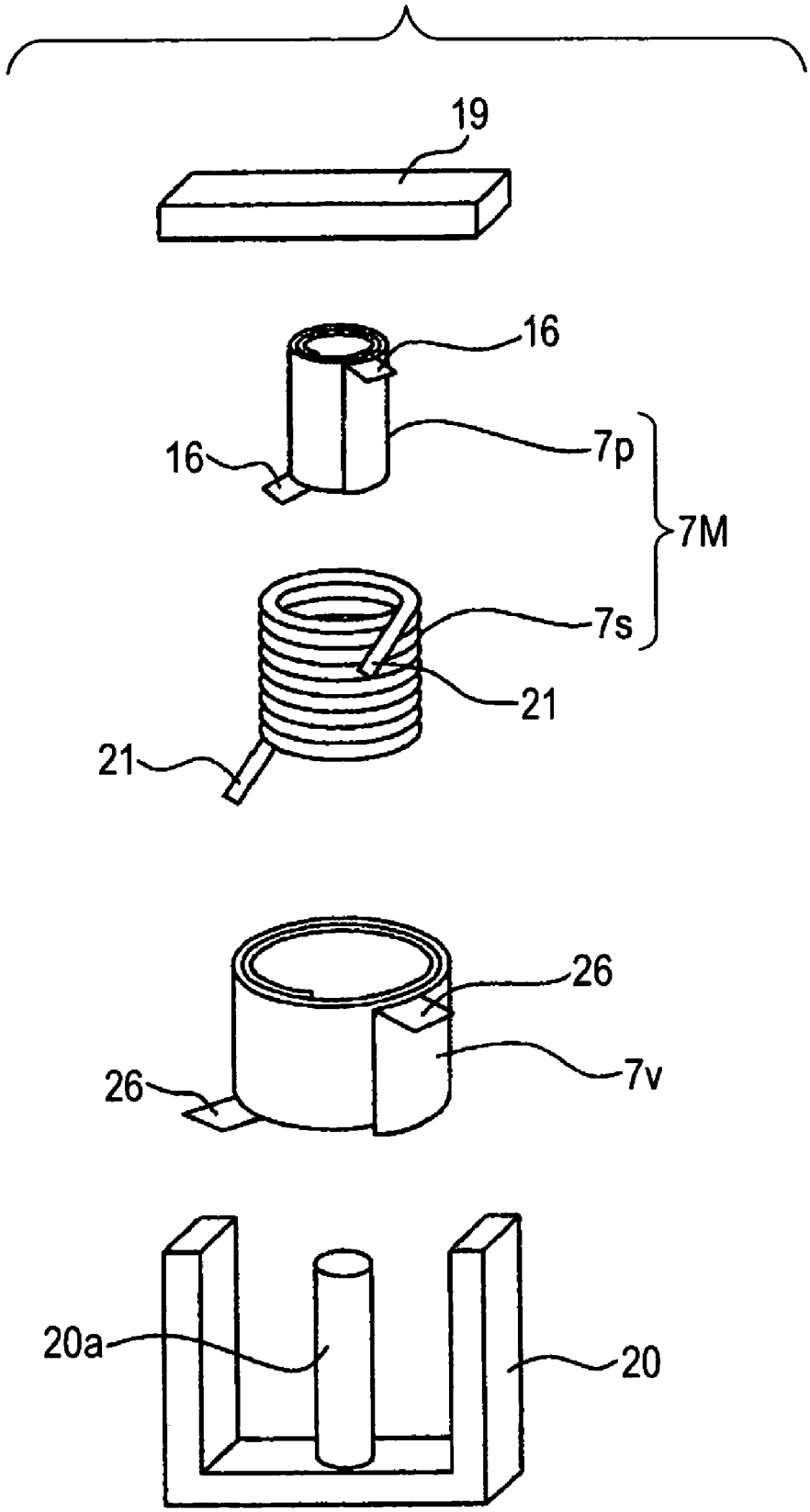
FIG. 10 is a view showing an example of the structure of the transformer using a detecting winding.

For example, as seen from FIG. 10, the detecting winding 7*v* is arranged on the outer periphery of the secondary winding 7*s*. The detected voltage is obtained from terminals 26, 26 at both ends of the detecting winding 7*v*. The terminals 26, 26 are located at diagonal positions on the opposite sides with respect to the winding direction of the detecting winding 7*v* like the case of FIG. 5.

In the structure shown in FIG. 10, the primary winding 7*p* is arranged on the outer periphery of the core column 20*a*, and the secondary winding 7*s* is arranged on the outer periphery of the primary winding 7*p*. Also, the detecting winding 7*v* is arranged on the outer periphery of the secondary winding 7*s*. Between the windings, the insulator (not shown) is arranged. However, other configurations may be adopted in which the secondary winding 7*s* is arranged on the outer periphery of the core column 20*a*, the primary winding 7*p* is arranged on the outer periphery of the secondary winding 7*s*, and further the detecting winding 7*v* is arranged on the outer periphery of the primary winding 7*p*. Furthermore, in addition to these configurations (as described below) the detecting winding 7*v* may be arranged on the inner periphery of the secondary winding 7*s* to obtain the detected voltage.

- The detecting winding 7*v* is arranged on the outer periphery of the core column 20*a*; the primary winding 7*p* is arranged on the outer periphery thereof; and the secondary winding 7*s* is arranged on the outer periphery thereof. The insulator is arranged between the windings.
- The detecting winding 7*v* is arranged on the outer periphery of the core column 20*a*; the secondary winding 7*s* is arranged on the outer periphery thereof; and the primary winding 7*p* is arranged on the outer periphery thereof. The insulator is arranged between the windings.

As described above, to prevent the loose/dense state of the coupling between the primary winding and the secondary winding which constitute the main winding (i.e., unevenness or inequality in the distribution tendency in the coupling coefficients), the primary winding is formed of the sheet- or film-like conductor in a cylindrical shape, and the winding portion of the primary winding is located with a length sufficient to completely include the secondary winding. Further, at a position apart from the gap of the magnetic circuit, the primary winding and secondary winding are wound around the common core column.

For configurations in which the transformer having the structure described above is employed, for example, in the circuit of FIG. 1, driving control of the switching elements 5H and 5L provides the DC-AC conversion, the transformer 7 boosts the primary voltage generated by the series resonance circuit including the capacitor 8, and power is supplied to the discharge lamp 10. The transformer 7 performs the dual functions of transmitting power to the discharge lamp 10 and supplying a start signal to the discharge lamp 10.

The accurate detected voltage is obtained and supplied to the control unit 6 by the detecting terminal located on the way of the secondary winding 7*s* of the transformer 7 or the detecting winding 7*v*. Under control of the control unit, DC-AC conversion and voltage boosting are carried out by the input DC-AC conversion circuit 3 to provide power control for the discharge lamp 10. In addition, when the discharge lamp 10 is activated, the start signal is generated by the starting circuit 4 and applied to the discharge lamp 10 through the main winding 7M of the transformer 7.

Other implementations are within the scope of the claims.

What is claimed is:

1. A transformer comprising a closed-magnetic circuit type of core having a gap, a main winding including a primary winding and a secondary winding, and at least one of a detecting terminal located on the secondary winding or an additional detecting winding separate from the main winding, wherein said primary winding and secondary winding are wound around a portion apart from the gap of a common core column of said core; and said primary winding is formed of a sheet- or film-like conductor, and the winding portion of said primary winding is arranged with a length sufficient to include the winding portion of said secondary winding in a direction along a center axis of the common core column.

2. A transformer according to claim 1, wherein said additional detecting winding is formed of a sheet- or film-like conductor, and the winding portion of said detecting winding is arranged with a length sufficient to include the winding portion of said secondary winding in the direction along the center axis of the common core column.

3. A transformer according to claim 1, wherein a pair of terminals attached to said primary winding are located at diagonal positions on opposite sides with respect to a winding direction of said primary winding.

4. A transformer according to claim 2, wherein a pair of terminals attached to said detecting winding are located at diagonal positions on opposite sides with respect to a winding direction of said detecting winding.

5. A discharge lamp lighting device comprising a DC-AC conversion circuit which includes a transformer to provide power transmission to a discharge lamp and converts an input DC voltage into an AC voltage so as to supply an output from the transformer to the discharge lamp, and a starting circuit to supply a start signal to the discharge lamp, wherein said transformer includes a closed-magnetic circuit type of core having a gap, a main winding including a primary winding and a secondary winding, and at least one of a detecting terminal located on the secondary winding or an additional detecting winding separate from the main winding, wherein said primary winding and secondary winding are wound around a portion apart from the gap of a common core column of said core serving as a center axis; and said primary winding is formed of a sheet- or film-like conductor, and the winding portion of said primary winding is arranged with a length sufficient to include the winding portion of said secondary winding in a direction along the center axis of the core column.

* * * * *